United States Patent [19]

Schnell

[11] 4,131,166

[45] Dec. 26, 1978

[54] PILE DRIVING DEVICE

[75] Inventor: Hans G. Schnell, Hamburg, Fed. Rep. of Germany

[73] Assignee: Van Kooten B.V., Naarden, Netherlands

[21] Appl. No.: 757,284

[22] Filed: Jan. 6, 1977

Related U.S. Application Data

[63] Continuation of Ser. No. 594,238, Jul. 9, 1975, abandoned.

[30] Foreign Application Priority Data

Jul. 26, 1974 [NL] Netherlands ..... 7410148

[51] Int. Cl.[2] ..... E02D 7/06

[52] U.S. Cl. ..... 173/43; 405/232

[58] Field of Search ..... 173/44, 43; 61/53.5

[56] References Cited

U.S. PATENT DOCUMENTS

| | | | |
|---|---|---|---|
| 1,131,048 | 3/1915 | Erickson | 173/44 |
| 1,879,993 | 9/1932 | Salmon | 61/53.5 |
| 3,242,997 | 3/1966 | Tokola | 61/53.5 X |

FOREIGN PATENT DOCUMENTS

| | | | |
|---|---|---|---|
| 697350 | 11/1964 | Canada | 173/43 |

*Primary Examiner*—Ernest R. Purser
*Assistant Examiner*—William F. Pate, III
*Attorney, Agent, or Firm*—Lewis H. Eslinger

[57] ABSTRACT

In a pile driving device for driving a pile particularly into a soil located beneath a body of water, said device mainly comprising a hammer, a guide frame for guiding said hammer and suspension means for suspending the guide frame to a lifting device, said guide frame comprising a base piece surrounding the pile with sliding fit and at least one guide stay fastened to said base for guiding the hammer, the suspension means engage the hanger of the lifing device in a vertical plane of suspension extending transversely of the guide frame and located near the center of gravity of the driving device.

During the pile driving operation almost the whole weight of the driving device hangs upon the derrick, so that this weight does not expose the pile to bending forces. The danger of buckling of the pile is reduced as a result.

14 Claims, 8 Drawing Figures

PILE DRIVING DEVICE

Figure 1:
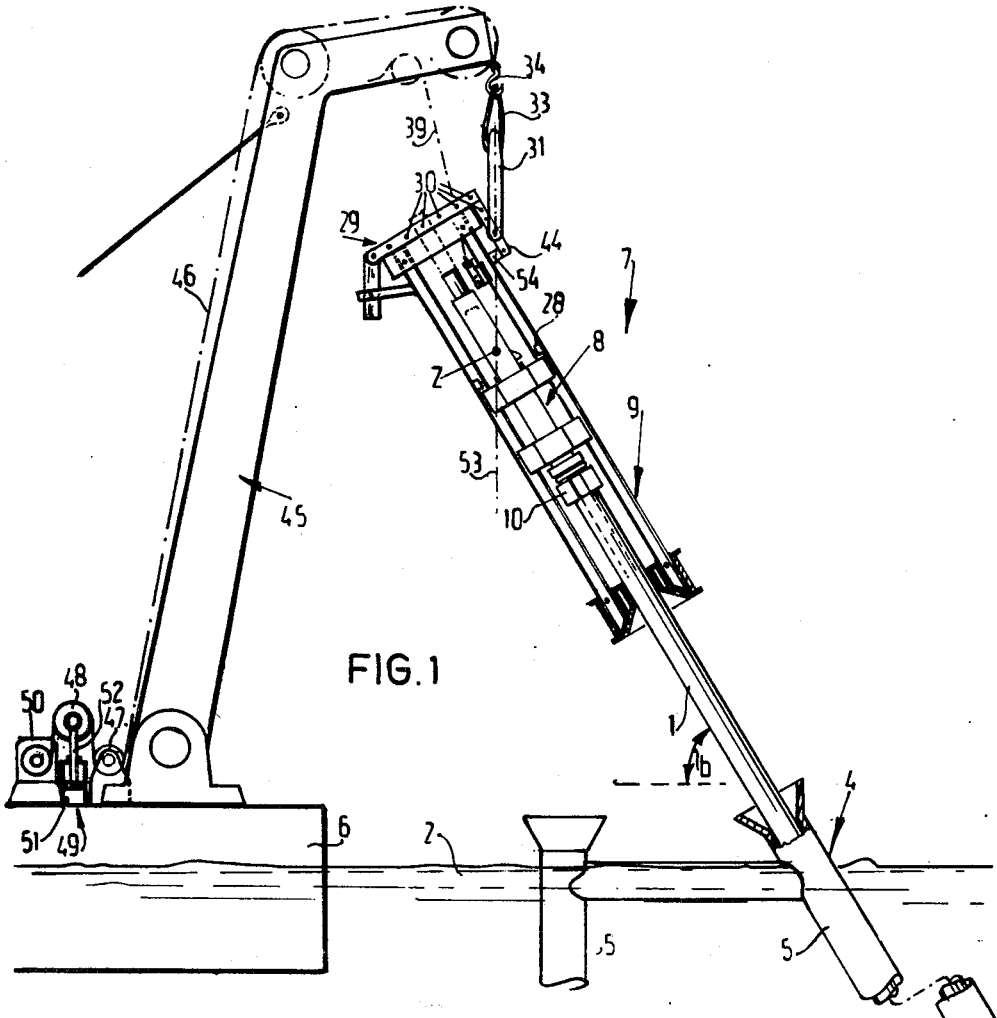

This is a continuation of application Ser. No. 594,238 filed July 9, 1975 now abandoned.

The invention relates to a device for driving a pile into the ground, particularly a subaqueous soil, said device comprising mainly a hammer, a guide frame for guiding said hammer and suspension means for suspending the guide frame to a hanger of a lifting device, said guide frame having a base piece engaging the pile with sliding fit in a passage and at least one guide stay fastened to the base for guiding the hammer.

Such a pile driving device is known. Herein the guide frame is connected at the top end in the plane of symmetry of the driving device with a bracket, which is suspended to the hanger of the lifting device.

Particularly if the pile has to be driven into the soil in a steeply sloping position, the pile is severely exposed to bending forces by the weight of the driving device so that in operation the risk of buckling of the pile arises.

The invention has for its object to avoid the risk of buckling of the pile.

According to the invention this is achieved by causing the suspension means to engage the hanger of the lifting device in a vertical suspension plane transverse of the guide frame and near the centre of gravity of the pile driving device. This pile driving device has the additional advantage that the guide frame can be readily put down on the pile to be driven.

The aforesaid and further features of the pile driving device embodying the invention will be explained with reference to the drawings.

Figure 3:
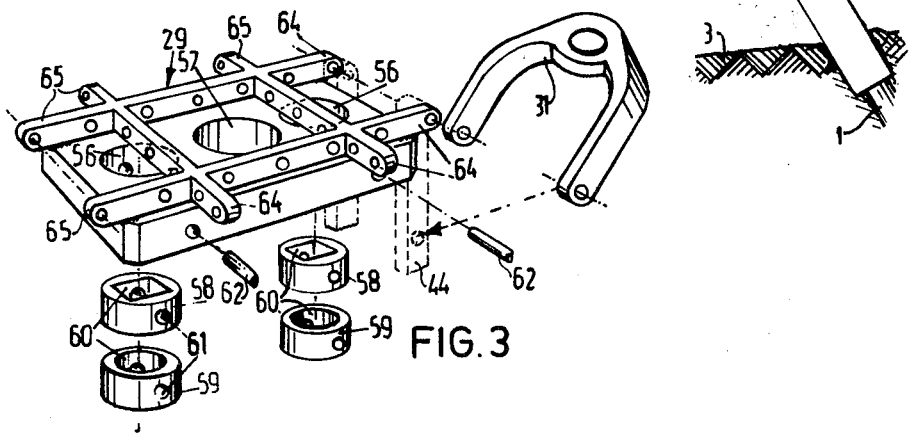
Figures 2, 8:
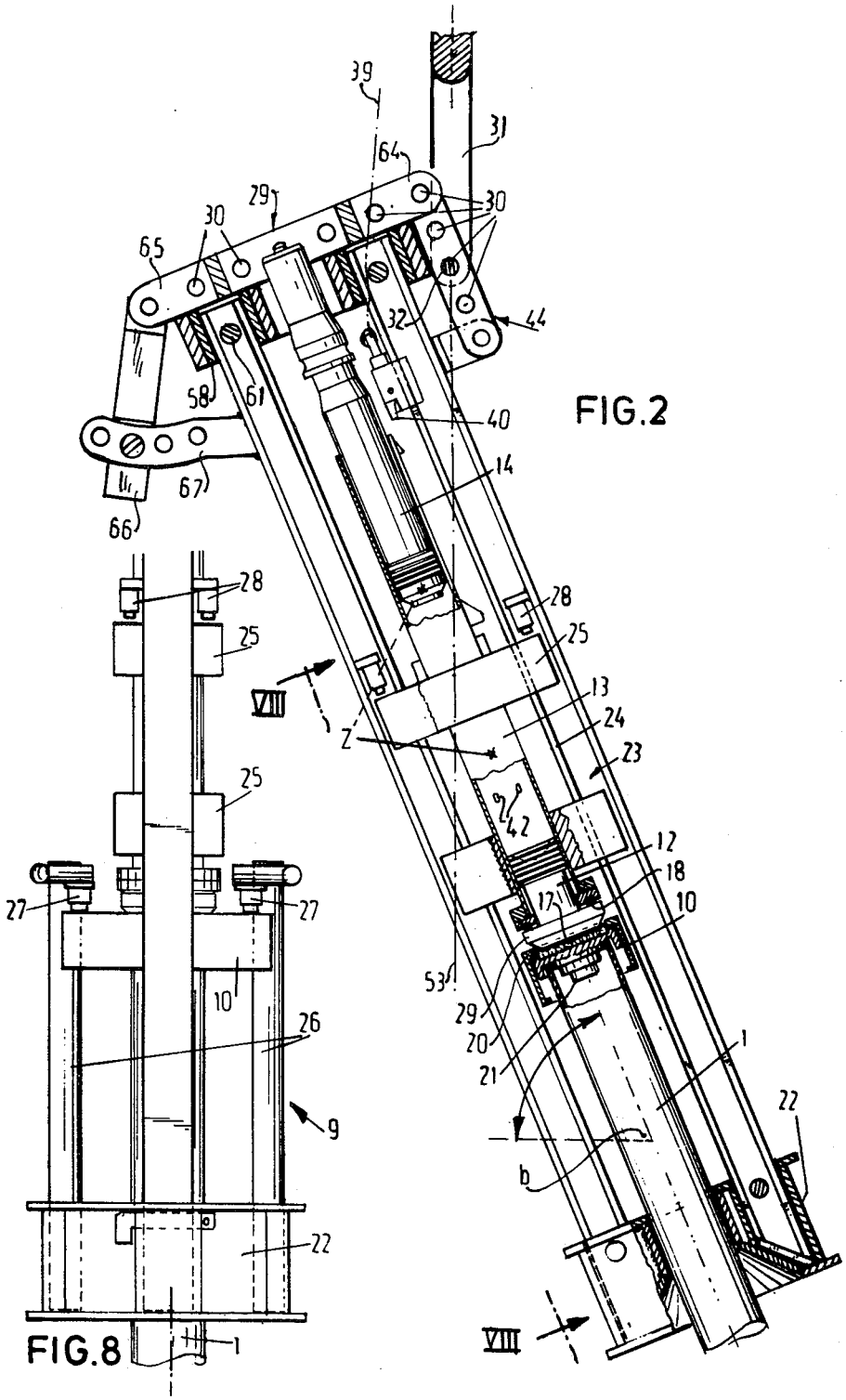
Figure 4:
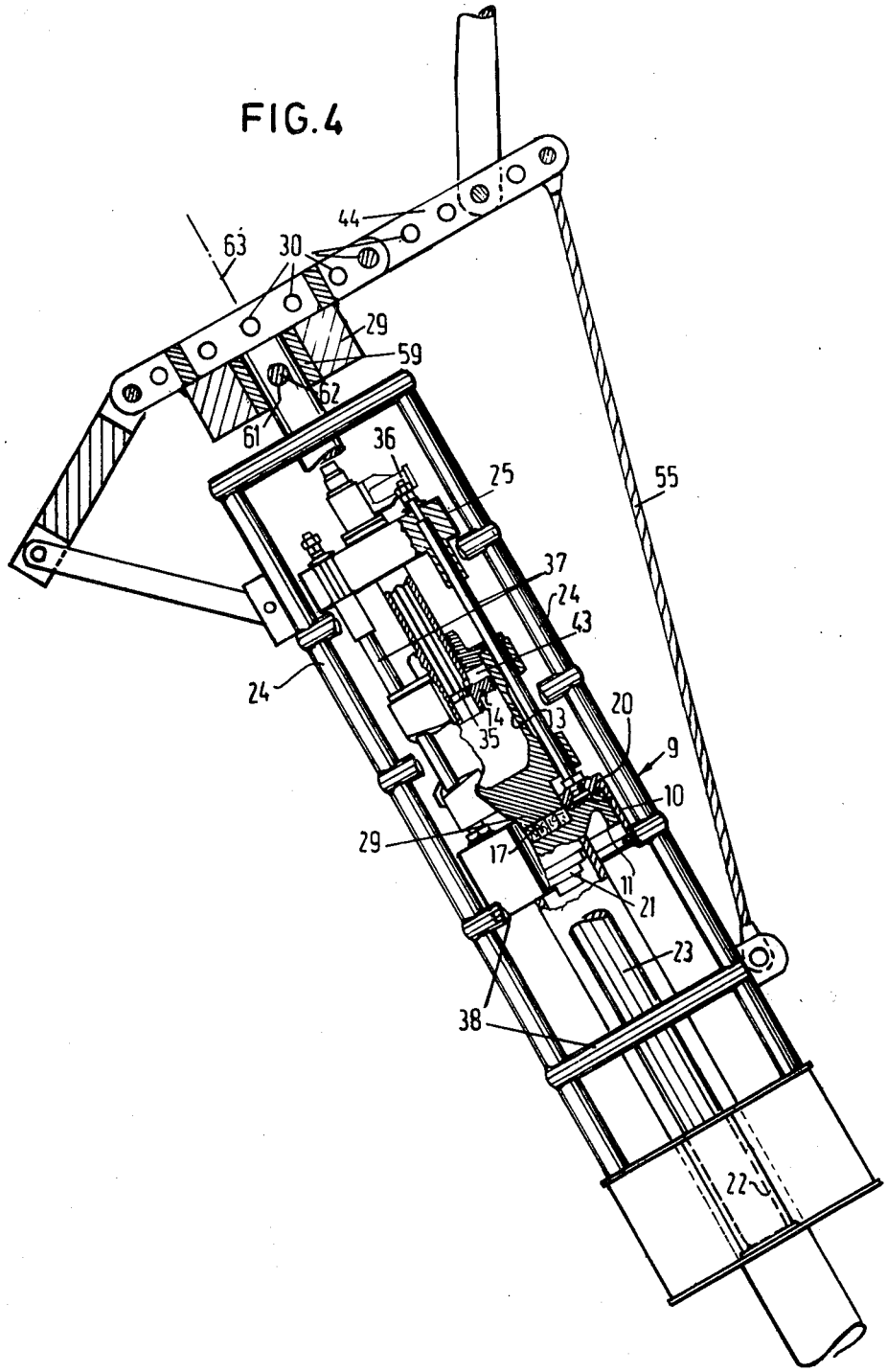
Figures 5, 6:
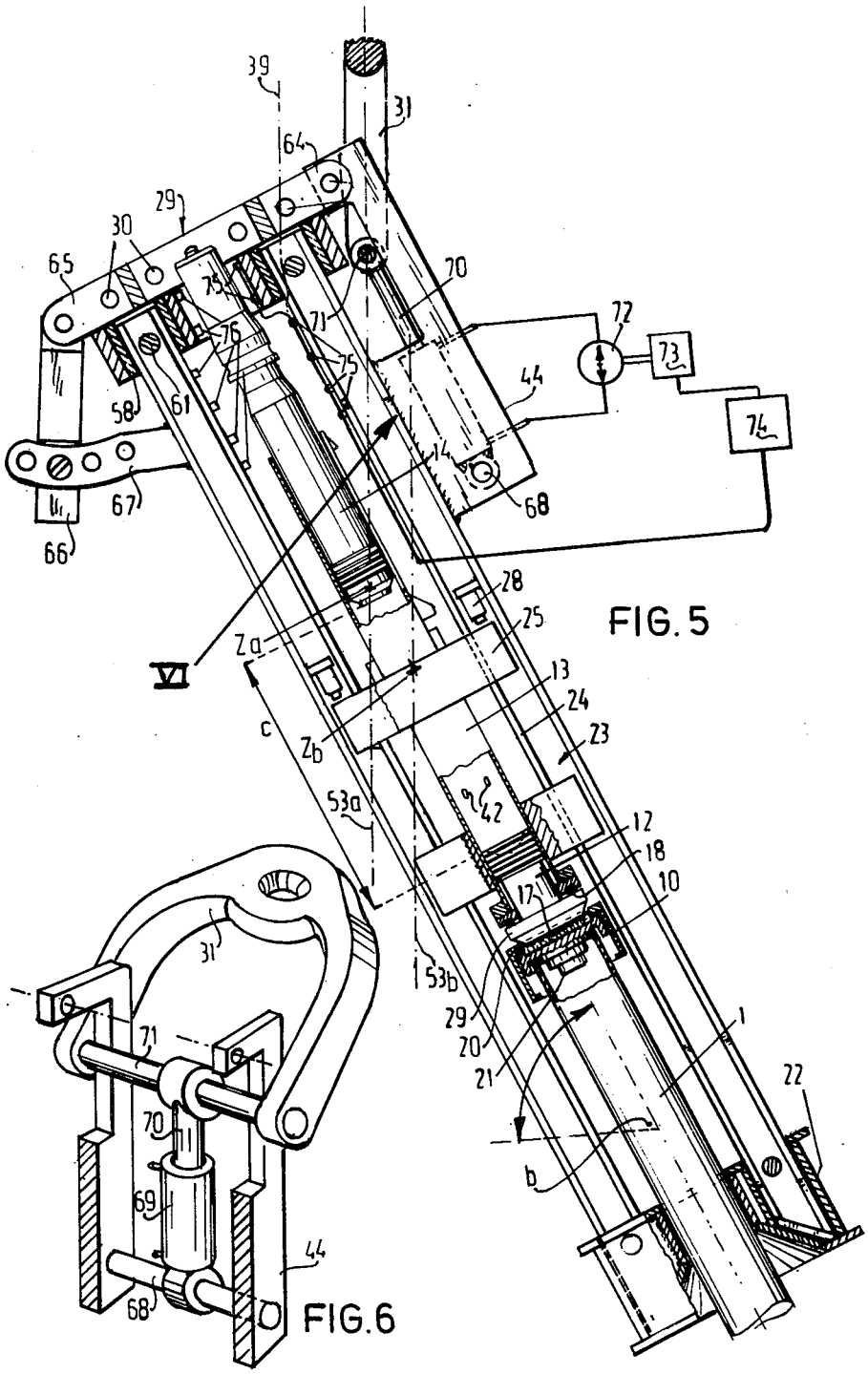

In the drawings:

FIG. 1 is a schematic survey of a pile driving operation by means of a device embodying the invention, FIG. 2 is an enlarged side elevation, partly broken away, of the pile driving device shown in FIG. 1, FIG. 3 is an enlarged, perspective view of the head of the guide frame of the pile driving device shown in FIG. 2, FIGS. 4, 5, and 7 are elevational views like FIG. 2 of different embodiments of the pile driving device in accordance with the invention, FIG. 6 is an enlarged perspective view of a detail 6 of FIG. 5 and FIG. 8 is an elevational view taken in the direction of the arrows VIII in FIG. 2.

Before a pile 1 is driven into a subaqueous soil 3, first a setting frame 4 is disposed on the ground 3, said setting frame having guide cylinders 5 determining the spot and the position of the pile 1 to be driven. By means of a floating derrick 6 a driving device 7 is arranged on the pile 1.

Said driving device 7 comprises a hammer 8, a guide frame 9 for guiding the hammer 8 and a driving head guide 10 bearing on the driving head 11. The hammer 8 shown in FIGS. 1, 2, and 5 is a known Diesel hammer formed by a cylinder 13, a heavy piston 14 and a ram 12 slidable in sealing engagement with the cylinder 13 and a fuel pump 15 connected with a fuel tank 16 associated with the cylinder 13.

The ram 12 bears on the driving head 11 through a wooden intermediate layer 17. The cylinder 13 bears via rubber cushions 18 on a collar 19 of the ram 12. The driving head guide 10 bears by interposed rubber rings 20 on the driving head 11, which bears by a central portion 21 on the tubular pile 1.

The guide frame 9 comprises a base piece 22, two upright guide stays 23 secured to the base and provided with rails 24 for guiding the cylinder 13 by means of guide members 25 and two upright tubular rails 26 secured to the base 22. The guide frame 9 bears on the pile 1 through four springs 27 held by the rails 26 and via the driving head guide 10. The guide frame 9 bears, moreover, in the event of excessive rebounds of the pile 1, by means of four springs 28 fastened to the guide stays 23 and the cylinder 13 and the ram 12 on the pile 1.

The guide frame 9 comprises a head 29, fastened to two guide stays 23 and having a prolongation 44 extending beyong the guide frame 9. The head 29 and the prolongation 44 each have a plurality of fastening areas 30 for a suspension bracket 31. The suspension bracket 31 can be secured at will at one of the fastening areas 30 by means of a pivot pin. The suspension bracket 31 is suspended by means of a strap 33 to the hanger 34 formed by a hook of the lifting device 45 of the derrick 6. The hanger 34 suspends from a cable 46, which extends via a fixed guide disc 47 and an adjustable guide disc 48 of a roll compensator 49 to a winch 50. The roll compensator 49 comprises a hydro-pneumatic cylinder 51, whose piston rod 52 holds the guide disc 48. This roll compensator 49 maintains a tension of the cable 46, which substantially corresponds to the weight of the driving device 7 despite the rolling movements of the derrick 6.

According to the invention that fastening area 30 is chosen as a function of the angle of inclination b of the pile 1 at which the suspension means formed by the hanger of the strap 33 engage the hanger 34 of the lifting device 45 in a vertical suspension plane 53 transverse of the guide frame 9 near the centre of gravity Z of the driving device 7.

FIGS. 1 and 2 show that the prolongation 44 extends laterally in the direction of length of the guide frame 9 and is fastened by afastening member 54 to a guide stay 23.

FIG. 4 shows that the prolongation 44 projects transversely out of the guide frame 9 and is fastened by means of a drawing cable 55 to the lower end of the guide frame.

The head 29 of the guide frame 9 shown in FIG. 3 has, apart from a central passage 57 for the hammer 8, two recesses 56 receiving each a sleeve 58 or 59 having a passage 60 matching the rectangular or circular profile of a guide stay 23. The driving devices 7 shown in FIGS. 1, 2, 5 and 7 comprise each guide stays 23 of rectangular profile, whereas the driving device 7 of FIG. 4 comprises guide stays 23 of circular profile. The head 29 is secured to the guide stays 23 by inserting fitting pins 62 into the registering holes 61 of the head 29, the sleeve 58 or 59 and the guide stays 23.

The pile driving device 7 shown in FIGS. 1, 2, 5 and 7 operates as follows. After the driving device 7 has been disposed on the pile 1, the piston 14 is lifted by means of a hook 40, guided along the rails 24 and lifted by means of a cable 39 from the derrick 6. When the piston 14 is released so that it drops down it actuates through a control-member a fuel pump which sprays fuel onto the ram 12. The air contained in the cylinder 13 is compressed and the fuel ignites by the impact of the piston on the ram 12. By this stroke the pile 1 disappears to some extent into the soil 3 and the piston 14 is lifted by the explosion so that the flue gases can escape through ports 42, through which free air enters, after which the strokes are repeated.

The hammer 8 shown in FIG. 4 is a vapour-driven hammer comprising a heavy cylinder 13, a piston 14 rigidly secured to a guide member 25 and a steam supply 36 controlled by a steam slide 35. The driving head guide 10 is connected by means of the rods 37 with the guide member 25. The guide member 25 is displaceable along upright rails 24 of guide stays 23 having the aforesaid circular profile and forming a cage-like guide frame 9 together with the base 22 and the brackets 38. The guide frame 9 bears on the pile 1 through springs, the guide member 25 the setting rods 37, the driving head guide 10, the rubber ring 20 and the driving head 11.

The pile driving device 7 shown in FIG. 4 operates as follows. Each time when the steam slide 35 is opened, the cylinder 13 is lifted relatively to the stationary piston 14. In the topmost position of the cylinder 13 the steam slide 35 is lifted so that the steam can escape from the top chamber 43 of the cylinder 13. The cylinder 13 drops down and pushes the pile 1 somewhat further into the soil 3.

The head 29 shown in FIG. 3 is universally suitable for use in the pile driving devices shown in FIGS. 1, 2, 5 and 7 having a Diesel hammer 8 and in the driving device 7 of FIG. 4 having a steam hammer 8, although in contrast to FIGS. 1, 2, 5 and 7 the guide stays 23 of FIG. 4 are located in the plane 63 perpendicular to the plane of the drawing. For this purpose the head 29 has, in both perpendicular directions, ears 64 for fastening the prolongation 44. Opposite thereto ears 65 are provided for fastening a weight 66 formed by a heavy, solid plate, which can be fastened in different positions to an extension arm 67. The weight 66 ensures that in operation the driving device 7 will not turn about its axis of symmetry.

If the angle of inclination b is small, for example, 45 to 60° and the length of the stroke c of the hammer 8 is large, for example, 2 meters, the place of the centre of gravity Z changes materially. In this case it is preferred to displace the suspension means in accordance with the lifting height of the hammer 8 in operation, that is to say, in synchronism with the hammer movement. A suitable pile driving device 7 for this purpose is shown in FIGS. 5 and 6. The prolongation 44 is provided with a hydraulic cylinder 69, secured thereto by means of a pivot pin 68, the piston rod 70 of which engages a suspension rod 71 of the suspension bracket 31 guided along the prolongation 44.

The cylinder 69 is fed by fluid in one direction or the other by a pump 72, driven by an electric motor 73. A control-member 74 controls the electric motor 73 in dependence upon signals supplied by photo-cells 75 irradiated or not irradiated by light sources 76 according as the piston 14 of the hammer 8 intervenes or does not intervene. In this manner, when the piston 14 is lifted with the associated centre of gravity ZA, the suspension means engage the hanger 34 in the vertical suspension plane 53A, whereas when the piston 14 has been lowered with the associated centre of gravity ZB the suspension means engage the hanger 34 in the vertical suspension plane 53B. The arrangement is such that the vertical suspension plane 53 is maintained near the shifting centre of gravity.

Figure 7:
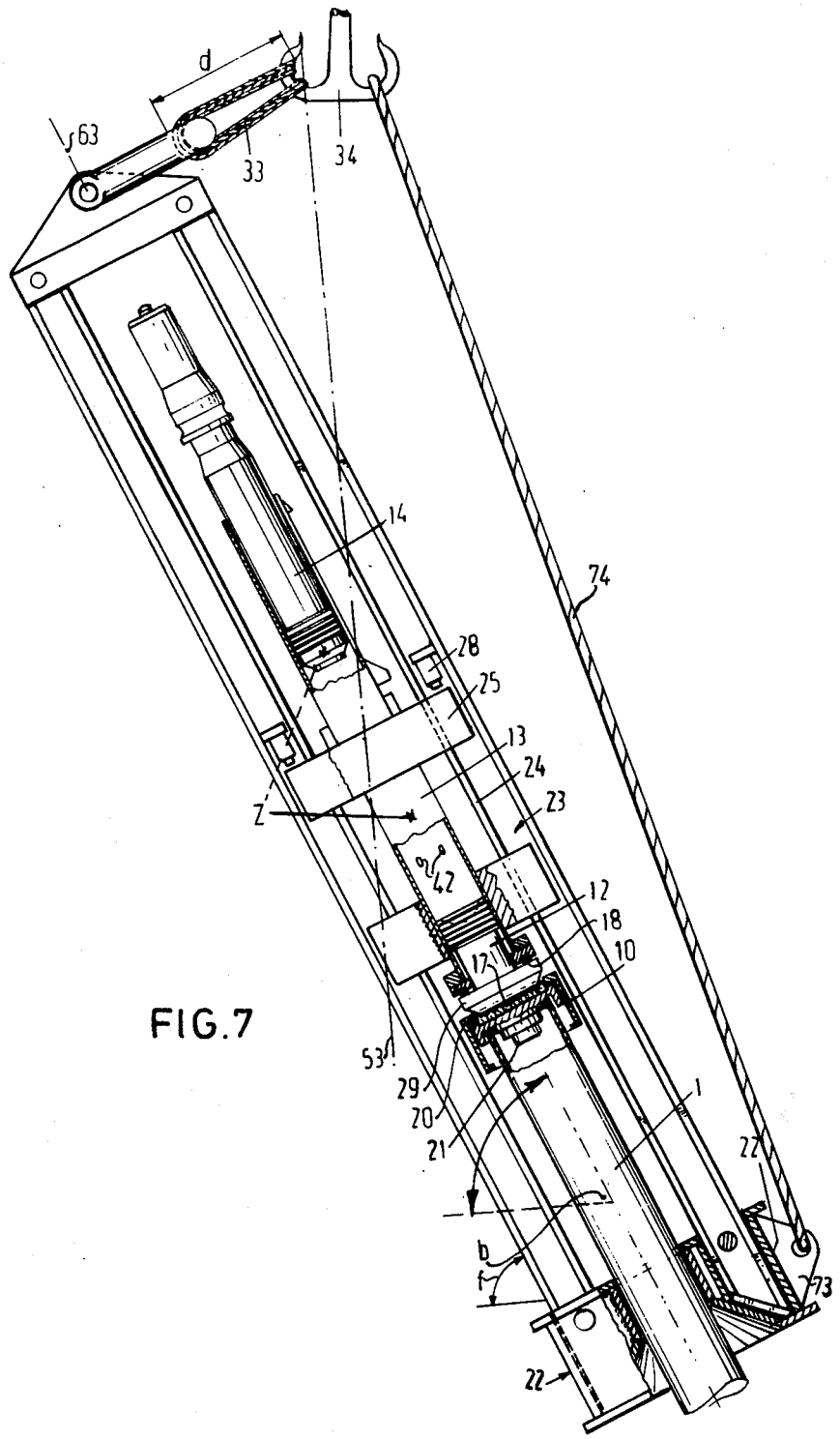

FIG. 7 illustrates how the invention may be applied by simple means to a conventional pile driving device 7. In order to arrange the vertical plane of suspension 53 near the centre of gravity Z, a cable 74 is arranged between the hanger 34 of the lifting device 45 and an ear 73 welded to the base 22, whilst a strap 33 of the required length d is arranged between the suspension bracket 31 engaging the head 29 of the guide frame 9 in the plane of symmetry 63 and the hanger 34. By varying the length of the strap d, for example, by changing the number of loops of the strap 34, the angle of inclination f of the driving device 7 can be made equal to the angle of inclination b of the pile 1 to be driven.

Since the weight of each of the driving devices 7 is mainly supported from the lifting device 45 and the pile 1 is, therefore, not loaded or hardly loaded by the stationary weight of the driving device 7, which is struck by the hammer 8 only in an axial direction, the pile 1 is loaded in a straight state instead of in a curved state, which is hightly conducive to the buckling resistance of the pile 1.

What I claim is:

1. A pile driving device for driving a pile particularly into a soil located beneath a body of water, said device being adapted to be suspended from the hanger of a lifting device and comprising, a hammer, a guide frame for guiding said hammer, and suspension means for suspending the guide frame to a lifting device, said guide frame including a base piece surrounding the pile to be driven with a sliding fit and at least one guide stay fastened to said base for guiding the hammer, said suspension means engaging the hanger of the lifting device in a vertical plane of suspension extending transversely of the guide frame and located near the center of gravity of the pile driving device; and a head fastened to at least one guide stay of the guide frame, said head having a plurality of fastening areas for a suspension bracket.

2. A pile driving device as claimed in claim 1, wherein said head has a prolongation extending beyond the guide frame and has at least one additional fastening area for the suspension bracket.

3. A pile driving device as claimed in claim 1, wherein said head has a prolongation extending transversely beyond the guide frame and has at least one additional fastening area for the suspension bracket.

4. A pile driving device as claimed in claim 1, wherein said head has a prolongation extending transversely beyond the guide frame and has at least one additional fastening area for the suspension bracket, said head being connected with the lower end of the guide frame with the aid of a drawing cable.

5. A pile driving device as claimed in claim 1, wherein said head has a prolongation extending beyond the guide frame and has at least one additional fastening area for the suspension bracket, said prolongation including at least one portion extending in the direction of length of the guide frame on the side thereof.

6. A pile driving device for driving a pile particularly into a soil located beneath a body of water, said device being adapted to be suspended from the hanger of a lifting device and comprising, a hammer, a guide frame for guiding said hammer, and suspension means for suspending the guide frame to a lifting device, said guide frame including a base piece surrounding the pile to be driven with a sliding fit and at least one guide stay fastened to said base for guiding the hammer, said suspension means engaging the hanger of the lifting device in a vertical plane of suspension extending transversely of the guide frame and located near the center of gravity of the pile driving device; and a suspension cable extending from the lower end of the guide frame to the hanger of the lifting device.

7. A pile driving device for driving a pile particularly into a soil located beneath a body of water, said device being adapted to be suspended from the hanger of a lifting device and comprising, a hammer, a guide frame for guiding said hammer, and suspension means for suspending the guide frame to a lifting device, said guide frame including a base piece surrounding the pile to be driven with a sliding fit and at least one guide stay fastened to said base for guiding the hammer, said suspension means engaging the hanger of the lifting device in a vertical plane of suspension extending transversely of the guide frame and located near the center of gravity of the pile driving device; said suspension means being adjustable in accordance with the lifting height of the driving device.

8. A pile driving device for driving a pile particularly into a soil located beneath a body of water, said device being adapted to be suspended from the hanger of a lifting device and comprising, a hammer, a guide frame for guiding said hammer, and suspension means for suspending the guide frame to a lifting device, said guide frame including a base piece surrounding the pile to be driven with a sliding fit and at least one guide stay fastened to said base for guiding the hammer, said suspension means engaging the hanger of the lifting device in a vertical plane of suspension extending transversely of the guide frame and located near the center of gravity of the pile driving device; including a weight counteracting a rotation of the guide frame and arranged beneath the inclined longitudinal plane of the driving device.

9. A pile driving device for driving a pile particularly into a soil located beneath a body of water, said device being adapted to be suspended from the hanger of a lifting device and comprising, a hammer, a guide frame for guiding said hammer, and suspension means for suspending the guide frame to a lifting device, said guide frame including a base piece surrounding the pile to be driven with a sliding fit and at least one guide stay fastened to said base for guiding the hammer, said suspension means engaging the hanger of the lifting device in a vertical plane of suspension extending transversely of the guide frame and located near the center of gravity of the pile driving device; and a head on the guide frame having recesses for receiving an individual sleeve having a passage matching the profile of a guide stay.

10. A pile driving device for driving pile supported by an external support frame system in an inclined position at an angle to the vertical particularly into soil located beneath a body of water, said device being adapted to be suspended from the hanger of a lifting device and comprising, a hammer, an inclined guide frame inclined at an angle to the vertical for guiding same hammer in the direction of inclination of said inclined pile, and suspension means for suspending said guide frame on the hanger of a lifting device, said guide frame comprising a base piece and at least one guide stay fastened to said base, said base piece completely surrounding said pile with a sliding fit for positioning the guide frame on the inclined pile so that its guide stay extends parallel to the direction of inclination of the pile, said guide stay guiding the hammer, said guide frame including means for selectively engaging said suspension means at a plurality of positions, with said suspension means extending vertically and comprising means for selectively and adjustably engaging said engaging means of the guide frame in a vertical plane of suspension in accordance with the angle of inclination of the pile, said plane extending transversely of said guide frame and being located to enclose an acute angle between the plane and said guide stay and said plane being located near the center of gravity of the driving device.

11. A pile driving device for driving an inclined pile supported by an external support frame system in an inclined position at an angle to the vertical, particularly into soil located beneath a body of water, said device being adapted to be suspended from a hanger of a lifting device and comprising, a hammer, an inclined guide frame including a base piece completely surrounding the pile with a sliding fit for positioning the guide frame on the inclined pile in the direction of inclination of said inclined pile, at least one guide stay fastened to said base for guiding the hammer and extending parallel to the direction of inclination of said pile, and means for engaging the hanger of a lifting device in a vertical plane of suspension extending transversely of the guide frame whereby said plane is located to enclose an acute angle between the plane and said guide stay and near the center of gravity of the driving device; said engaging means comprising means providing a support opening in said guide frame remote from the longitudinal axis of the guide frame for operative engagement with said hanger whereby the plane of suspension of the guide frame on the hanger extends transversely of said guide frame at an angle to the longitudinal axis thereof; and suspension means for operatively connecting said support opening to said hanger.

12. A pile driving device for driving an inclined pile supported by an external support frame system in an inclined position at an angle to the vertical, particularly into soil located beneath a body of water, said device being adapted to be suspended from a hanger of a lifting device and comprising, a hammer, an inclined guide frame including a base piece completely surrounding the pile with a sliding fit for positioning the guide frame on the inclined pile in the direction of inclination of said inclined pile, at least one guide stay fastened to said base for guiding the hammer and extending parallel to the direction of inclination of said pile, and means for engaging the hanger of a lifting device in a vertical plane of suspension extending transversely of the guide frame whereby said plane is located to enclose an acute angle between the plane and said guide stay and near the center of gravity of the driving device; said engaging means comprising means providing a support opening in said guide frame remote from the longitudinal axis of the guide frame for operative engagement with said hanger whereby the plane of suspension of the guide frame on the hanger extends transversely of said guide frame at an angle to the longitudinal axis thereof; said means providing a support opening providing a plurality of openings radially spaced from the longitudinal axis of the guide frame.

13. A pile driving device as defined in claim 12 wherein said support openings are all spaced the same radial distance from the longitudinal axis of the guide frame along the side of the guide frame.

14. A pile driving device as defined in claim 12 wherein at least some of the support openings are each located at different radial distances from the longitudinal axis of the guide frame.

* * * * *